US011339024B1

(12) United States Patent
Bigbee, Jr. et al.

(10) Patent No.: US 11,339,024 B1
(45) Date of Patent: May 24, 2022

(54) GROUND WIRE SIDE CAR

(71) Applicant: Encore Wire Corporation, McKinney, TX (US)

(72) Inventors: William T. Bigbee, Jr., Melissa, TX (US); Kevin D. Rodgers, Little Elm, TX (US); John L. Rhoads, The Colony, TX (US)

(73) Assignee: Encore Wire Corporation, McKinney, TX (US)

( * ) Notice: Subject to any disclaimer, the term of this patent is extended or adjusted under 35 U.S.C. 154(b) by 216 days.

(21) Appl. No.: 16/863,878

(22) Filed: Apr. 30, 2020

Related U.S. Application Data

(63) Continuation-in-part of application No. 16/822,940, filed on Mar. 18, 2020, now Pat. No. 11,186,461, which is a continuation of application No. 16/016,645, filed on Jun. 24, 2018, now Pat. No. 10,625,975, which is a continuation of application No. 15/594,299, filed on May 12, 2017, now Pat. No. 10,421,636, which is a continuation of application No. 15/134,254, filed on Apr. 20, 2016, now Pat. No. 9,676,587, which is a continuation-in-part of application No. 14/659,165, filed on Mar. 16, 2015, now Pat. No. 9,738,485, which is a (Continued)

(51) Int. Cl.

| | |
|---|---|
| ***B65H 49/32*** | (2006.01) |
| ***B65H 75/18*** | (2006.01) |
| ***B65H 49/20*** | (2006.01) |
| ***B65H 75/14*** | (2006.01) |
| ***B65H 75/40*** | (2006.01) |

(52) U.S. Cl.
CPC ..... *B65H 49/32* (2013.01); *B65H 49/205* (2013.01); *B65H 49/324* (2013.01); *B65H 75/146* (2013.01); *B65H 75/18* (2013.01); *B65H 75/40* (2013.01)

(58) Field of Classification Search
CPC .... B65H 49/205; B65H 49/32; B65H 49/324; B65H 75/146; B65H 75/18; B65H 75/40
See application file for complete search history.

(56) References Cited

U.S. PATENT DOCUMENTS 709,932 A 9/1902 Schooley
970,884 A 9/1910 Carter
(Continued)

FOREIGN PATENT DOCUMENTS

GB 353684 A 7/1931

OTHER PUBLICATIONS

Carrisreels, "10-inch Caddies for in-the-box packaging reels from Carris Reels", Carris Reels, Inc. 2008, http://carris.com/products/caddy10.html (Printed from website Oct. 11, 2012).

*Primary Examiner* — William E Dondero
(74) *Attorney, Agent, or Firm* — Warren Rhoades LLP

(57) ABSTRACT

An apparatus for the transportation and dispensing of spooled wire or cable, the apparatus comprising a payoff reel, wherein the payoff reel comprises an arbor hole having a payoff reel diameter and a detachable side car reel, wherein the detachable side car reel comprises an arbor hole having a detachable side car reel diameter and wherein the detachable side car reel is attachable to the payoff reel and wherein the detachable side car reel further comprises a reel lift.

21 Claims, 7 Drawing Sheets

Related U.S. Application Data continuation-in-part of application No. 14/072,539, filed on Nov. 5, 2013, now Pat. No. 9,452,908, and a continuation of application No. 13/545,501, filed on Jul. 10, 2012, now Pat. No. 9,004,392.

(60) Provisional application No. 62/841,470, filed on May 1, 2019, provisional application No. 61/722,478, filed on Nov. 5, 2012.

(56) References Cited

U.S. PATENT DOCUMENTS

| | | | | |
|---|---|---|---|---|
| 3,152,772 | A | 10/1964 | Schjerven | |
| 3,652,026 | A | 3/1972 | Awebro | |
| 3,976,260 | A | 8/1976 | Irik | |
| 4,784,221 | A | 11/1988 | Share et al. | |
| 6,361,021 | B1 | 3/2002 | Brennan | |
| 8,025,261 | B2 | 9/2011 | Jordan et al. | |
| 8,245,965 | B2 | 8/2012 | Andrea et al. | |
| 8,444,078 | B1 | 5/2013 | Brown et al. | |
| 9,452,908 | B1 * | 9/2016 | Bigbee, Jr. ..... | B65H 75/146 |
| 2002/0005451 | A1 | 1/2002 | Valverde | |
| 2008/0023579 | A1 | 1/2008 | Leonard et al. | |
| 2010/0084500 | A1 | 4/2010 | Inman et al. | |
| 2010/0230528 | A1 | 9/2010 | Singleton | |
| 2011/0095124 | A1 | 4/2011 | Andrea et al. | |
| 2015/0129703 | A1 | 5/2015 | Kucera | |
| 2015/0321876 | A1 | 11/2015 | Galindo et al. | |
| 2017/0008718 | A1 | 1/2017 | Evans | |

* cited by examiner

GROUND WIRE SIDE CAR

CROSS-REFERENCE TO RELATED APPLICATIONS

The subject application claims priority to and benefit of U.S. Provisional Application Ser. No. 62/841,470, filed on May 1, 2019, and is a continuation-in-part of U.S. patent application Ser. No. 16/822,940, filed Mar. 18, 2020, which is a continuation of Ser. No. 16/016,645, filed Jun. 24, 2018, now issued as U.S. Pat. No. 10,625,975, issued Apr. 21, 2020, which is a continuation of U.S. patent application Ser. No. 15/594,299, filed May 12, 2017, now issued as U.S. Pat. No. 10,421,636, on Sep. 24, 2019, which is a continuation of U.S. patent application Ser. No. 15/134,254, filed Apr. 20, 2016, now issued as U.S. Pat. No. 9,676,587, issued Jun. 13, 2017, which is a continuation-in-part of U.S. patent application Ser. No. 14/659,165, filed Mar. 16, 2015, now issued as U.S. Pat. No. 9,738,485, issued Aug. 22, 2017, which is a continuation of U.S. patent application Ser. No. 13/545,501, filed Jul. 10, 2012, now issued as U.S. Pat. No. 9,004,392, issued Apr. 14, 2015, and U.S. patent application Ser. No. 14/072,539, filed Nov. 5, 2013, now issued as U.S. Pat. No. 9,452,908, issued Sep. 27, 2016 which claims priority to and benefit of U.S. Provisional Application Ser. No. 61/722,478, filed on Nov. 5, 2012, all of which are incorporated in their entirety by reference.

STATEMENT REGARDING FEDERALLY SPONSORED RESEARCH OR DEVELOPMENT

Not applicable.

REFERENCE TO A COMPACT DISK APPENDIX

Not applicable.

BACKGROUND OF THE INVENTION

1. Field of the Invention

This invention relates to an apparatus for transporting and dispensing wire or cable. More specifically, it relates to a secondary wire reel that attaches to and is removable from a main reel of wire and cable.

2. Description of Related Art

To distribute electricity throughout a building, insulated electrical wires or cables are installed between a power source and a power distribution box and routed to electrical boxes to supply electricity to a device. Often, these electrical wires or cables are routed through multiple conduits throughout the building spanning great distances. As such, installing electrical wires presents both logistical and mechanical challenges. Wires are typically installed in a building by pulling the wire via pulling cables through the building's infrastructure. The wire is spooled off of one or more reel assemblies during the wire pulling process.

Wire is typically transported from a wire manufacturing site to the building construction or installation site on the reel assembly typically made from metal or wood. These reel assemblies can have diameters of up to 48 inches or more, and are capable of carrying thousands of pounds of wire. At the construction site, construction workers are faced with the challenge of spooling the large bulk of wire from the reel assembly during a wire pull. The size and weight of the reels when carrying cable or wire present many problems associated with installation at the installation site. The reel assembly is usually lifted off of the ground and set upon a pair of jack stands, which allows the reel to freely spin during a wire pull. During a wire pull, one end of the wire is attached to a pulling cable. Today, electric-powered machines are used to apply a pulling tension to the pulling cable, thereby spooling the wire off of the reel and through the building's infrastructure.

The use of jack stands to support the reel assembly during a wire pull has a number of significant disadvantages. For example, it requires heavy machinery or multiple personnel to lift a large reel from the ground to the jack stand platform. This use of heavy machinery is both costly and dangerous to construction workers. Also, jack stands are themselves large pieces of equipment. They are difficult to transport, and when installed, they consume a large amount of floor space at a construction site. For smaller construction sites, the jack stand can present significant space challenges during construction. One solution to the above is to deliver the reel and wire to the construction site on a portable jack stand installed on a flat-bed truck. However, this solution also has many disadvantages. First, the jack stands are large and limit the amount of available flat-bed space to transport multiple reels. Second, flat-bed trucks can take up a large amount of space at a construction site when positioned for spooling. Another solution is to use portable jack stands with built-in lifting mechanisms. However, these jack stands require additional equipment, and again, they can take up an inconvenient amount of space at a construction site while still requiring that the reels be lifted off of the ground and placed in a jack stand. Moreover, this solution requires the use of additional pieces of equipment with associated costs and space requirements.

Moreover, many installations require multiple wires to be dispensed and installed together. Traditionally, this requires a reel for each wire and a jack stand for each reel, which further compounds the issues discussed above. One prior solution has included setting up an additional reel that had to be shipped separately on its own packaging to the end user. This solution makes it more difficult to find the space and manpower to place multiple reels in an area to be used. An example of this installation occurs during the installation of a single ground wire, generally a smaller sized wire, alongside of a paralleled reel of wire or other type of wire conductors. Typically the ground wire and paralleled reel of wire are transported on multiple pallets requiring the arrangement of the additional pallet or reel of the ground wire into a designated area for the installation of the paralleled reel of wire.

A prior art solution of dispensing multiple wires, including ground wire, includes incorporating multiple bays in one reel, which each wire spooled into each bay. This solution is susceptible to the faults of the prior art solutions discussed above. Additionally, in some installations, at least one wire may be of a different thickness than the remaining wires. In this situation, for each rotation of the reel, more wire of the smaller diameter is dispensed than of the larger diameter wire often causes twists, kinks, or other issues related to efficiently dispensing a plurality of wires for installation at the same time.

Thus, there is need in the art for a reel system that is compact, easily transportable, and capable of spooling multiple wires while allowing the additional single conductor wire to be packaged, shipped and dispensed separate from the mail reel of wire or cable.

BRIEF SUMMARY OF THE INVENTION

The present disclosure is directed at a system and apparatus for transporting and dispensing wire or cable wound on a reel or spool. The apparatus according to one embodiment is an apparatus for the transportation and dispensing of spooled wire or cable, the apparatus including a payoff reel, a side car reel, and a jack, wherein the jack raises and lowers the side car reel to allow dispensing of the cable. The side car reel and jack are attached to the payoff reel. One advantage of the apparatus is that it incorporates an additional reel of wire to the side of the main reel to allow for easier transport, packaging, and use at the end user jobsite.

BRIEF DESCRIPTION OF THE SEVERAL VIEWS OF THE DRAWINGS

The foregoing summary, as well as the following detailed description, will be better understood when read in conjunction with the appended drawings. For the purpose of illustration, there is shown in the drawings certain embodiments of the present disclosure. It should be understood, however, that the invention is not limited to the precise arrangements and instrumentalities shown.

In the drawings.

DETAILED DESCRIPTION OF THE INVENTION

Figure 1:
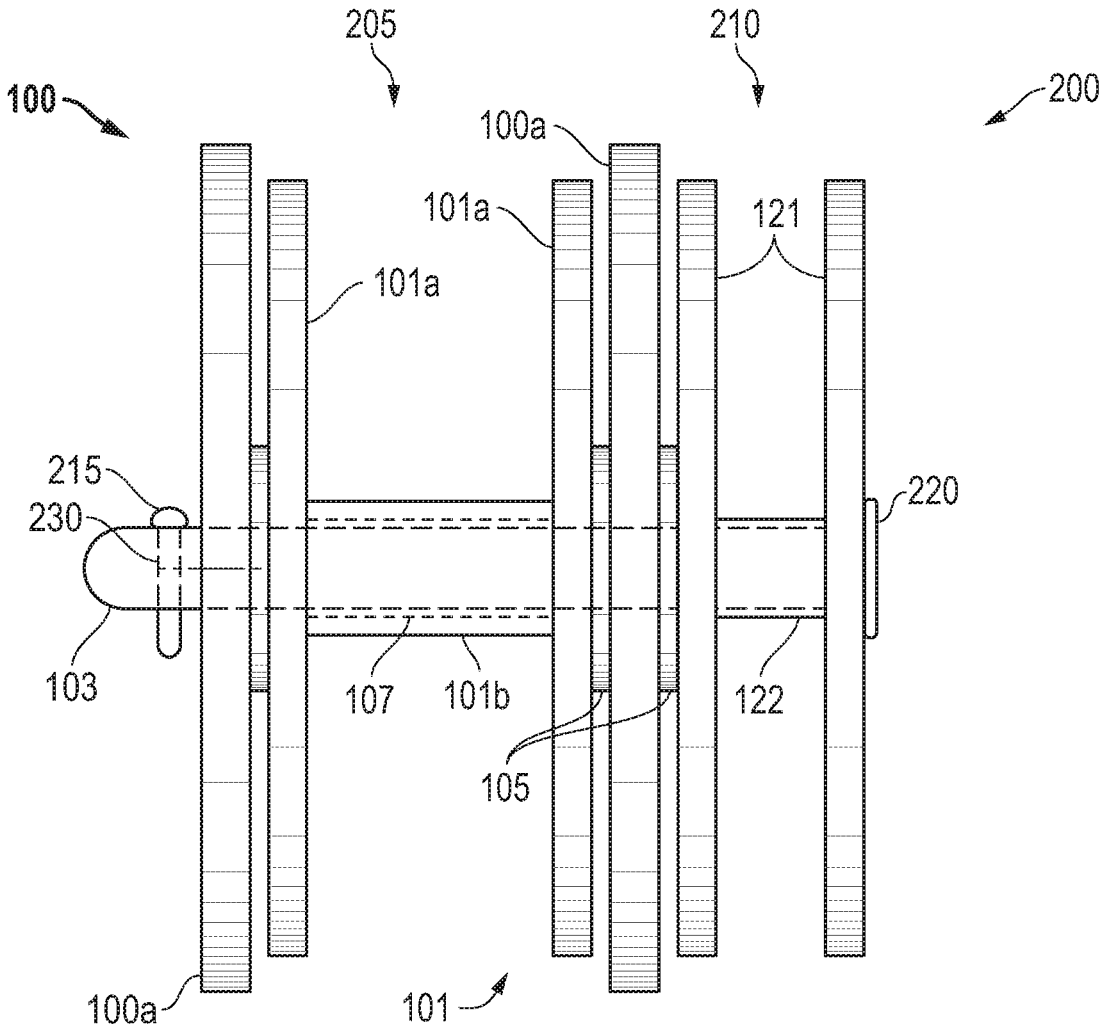
FIG. 1 depicts a front side view of one embodiment of a ground wire reel and a larger payoff reel system.

Before explaining at least one disclosed embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed are for purpose of description and should not be regarded as limiting.

It should be understood that any one of the features of the invention may be used separately or in combination with other features. Other systems, methods, features, and advantages of the present invention will be or become apparent to one with skill in the art upon examination of the drawings and the detailed description. It is intended that all such additional systems, methods, features, and advantages be included within this description, be within the scope of the present invention, and be protected by accompanying claims.

The present disclosure is described below with reference to the Figures in which various embodiments of the present invention are shown. The subject matter of the disclosure may, however, be embodied in many different forms and should not be construed as limited to the exemplary embodiments set forth herein. It is also understood that the term "wire" is not limiting, and refers to wires, cables, electrical lines, or any other materials that are dispensed from a reel.

The present invention provides for an apparatus for transporting spools of spooled wire and dispensing wire from the spool during installation of the wire. The apparatus is designed to make it easier to transport and dispense spools of wire on a jobsite. The apparatus incorporates an additional reel of wire to the side of the main reel to allow for easier transport, packaging, and use at the jobsite.

Figure 2:
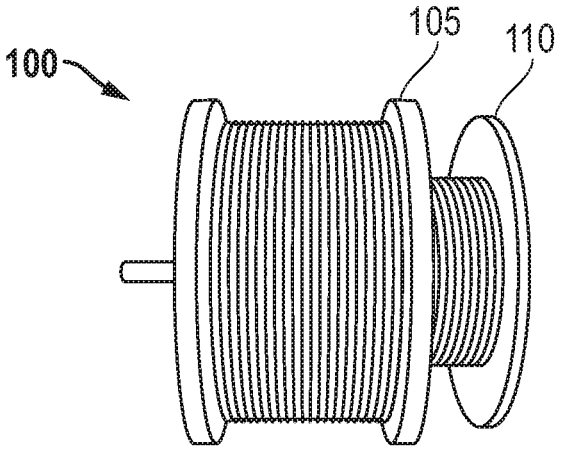
FIG. 2 depicts a front side view of one embodiment of a ground wire reel and a larger payoff reel system.
Figure 3:
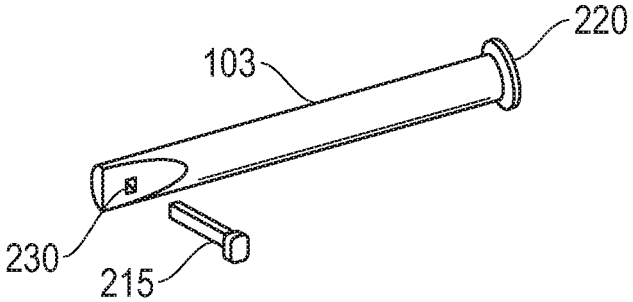
FIG. 3 depicts a perspective view of one embodiment of the flared shaft with locking pin.
Figure 4:
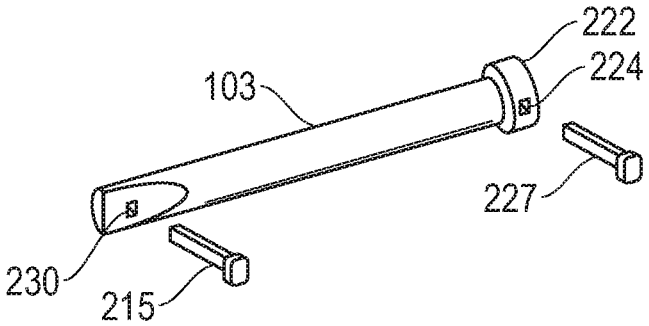
FIG. 4 depicts perspective view of one embodiment of the collared shaft with locking pin.

Referring now to FIGS. 1-4, an exemplary embodiment of a system of a ground wire reel and a larger payoff reel is shown. A side car reel assembly 200 includes a payoff reel 205 and a side car reel 210. The payoff reel 205 includes an outer assembly 100 and an inner assembly 101. The outer assembly 100 is formed by two outer supporting walls 100*a* connected via a tube or drum 107. The tube or drum 107 is hollow forming an arbor holes on each end of the payoff reel 205. Inner assembly 101 is formed by a plurality of inner supporting walls 101*a*, which form at least one bay in the inner assembly 101. The inner assembly 101 may include multiple bays. Each of the inner supporting walls 101*a* is connected to an inner drum 101*b* and all inner support walls 101*a* move in a way that is independent from the outer assembly 100. The inner drum 101*b* has a diameter greater than the diameter of the tube or drum 107 and the inner drum 101*b* is located around the tube or drum 107. A side car reel 210 is attached to the payoff reel 205 outside of the outer flange assembly 100 and a washer 105 may also be placed between the outer flange assembly 100 and the payoff reel 205. In this embodiment, the side car reel 210 moves independently of the outer flange assembly 100 and the inner flange assembly 101 which is contained within the outer flange assembly 100. The side car reel 210 is formed by a two supporting walls 121 and a drum 122. In this embodiment, the side car reel 210 outside of the outer flange assembly 100 may be removable from the payoff reel 205 and reattached as needed during installation of the wire. In this embodiment, the side car reel 210 may be secured to the payoff reel 205 by inserting a pipe or shaft 103 through the side car reel 210 and through the tube or drum 107 of the payoff reel 205. The pipe or shaft 103 is enclosed within the tube or drum 107, the inner drum 101*b* and the drum 121. A first end of the pipe or shaft 103 is flared 220 or alternatively, includes a nut or other device with a larger diameter than the pipe or shaft 103. The flared end 220 of the pipe or shaft 103 is larger than an arbor hole in the side car reel 210. The pipe or shaft 103 is secured by a pin or bolt 215 inserted into a locking hole 230 in the second end of the pipe 103, which in one embodiment is away from the side car reel 210. In another embodiment, the first end of the pipe or shaft 103 includes a collar 222 and pin hole 224 connected to the pipe or shaft 103. The collar 222 with a pin 227 placed through the pin hole 224 which passes through the collar 222 and through at least a portion of the pipe or shaft 103, including all of the way through the pipe or shaft 103, acts as a flared end 220 and prevents the first end of the pipe or shaft 103 from passing through the side car reel 210.

In one embodiment, the side car reel assembly 200, including the payoff reel 205, side car reel 210, and the pipe or shaft 103, are transported unassembled on a single pallet. Once the side car reel assembly 200 arrives at the destination, the payoff reel 205, side car reel 210, and pipe or shaft 103 are assembled on the transportation pallet. The pipe or shaft 103 is inserted into the arbor hole of the side car reel 210, which is surrounded by the drum 121, until the flared end 220 or the collar end 222 of the pipe or shaft 103 is in contact with the side car reel 210. The non-flared end of the pipe or shaft 103 is then inserted through the arbor hole of the payoff reel, which is surrounded by the inner drum 101*b*, until the side car reel is proximate the payoff reel 205. In one embodiment, an inner washer 105 or separator separates the side car reel 210 and the payoff reel 205. The non-flared end of the pipe or shaft 103 extends through the payoff reel 205 when the side car reel 210 is proximate the payoff reel 205 or inner washer 105. The non-flared end of the pipe or shaft 103 includes the locking hole 230 passing through the pipe or shaft 103. The portion of the pipe or shaft 103 that includes the locking hole 230 extends beyond the payoff reel 205. The pin or bolt 215 is inserted into the locking hole 230 to secure the pipe or shaft 103 to the payoff reel 205 and the side car reel 210. In another embodiment, the pipe or shaft 103 is inserted into the arbor hole of the side opposite the side car reel 210, which is surrounded by the drum 121, until the flared end 220 or the collar end 222 of the pipe or shaft 103 is in contact with the payoff reel 205. Wire or cable is spooled around the payoff reel 205 and the side car reel 210. The wire or cable may be of the same size and length or the wire or cable may be different lengths or different sizes. During transportation, the payoff reel 205 and side car reel 210 may be attached or may be unattached, allowing for attachment at the job site.

Figure 5:
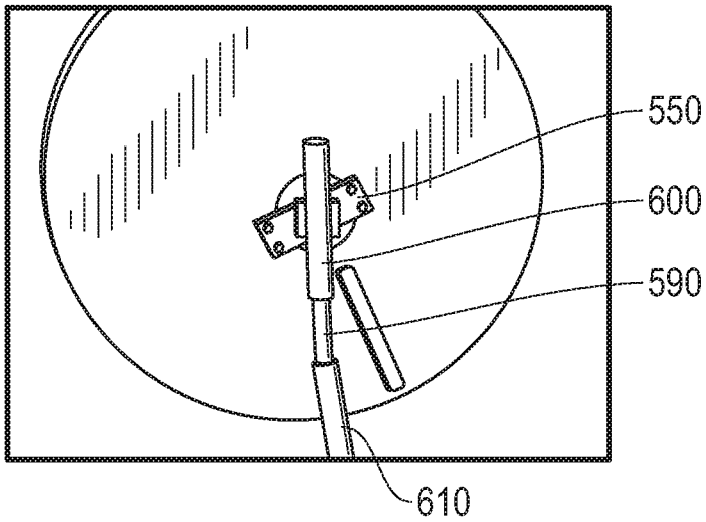
FIG. 5 depicts a side view of one embodiment of a ground wire reel and a larger payoff reel system.
Figure 6:
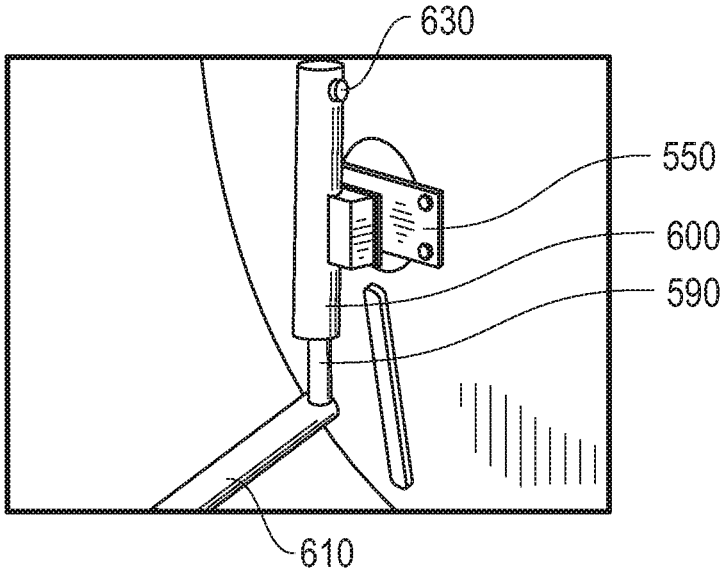
FIG. 6 depicts a perspective view of one embodiment of a ground wire reel and a larger payoff reel system.
Figure 7:
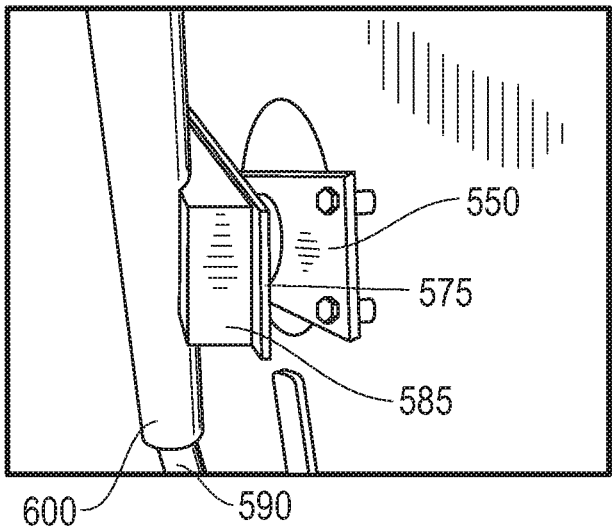
FIG. 7 depicts a perspective view of one embodiment of a ground wire reel and a larger payoff reel system.
Figure 8:
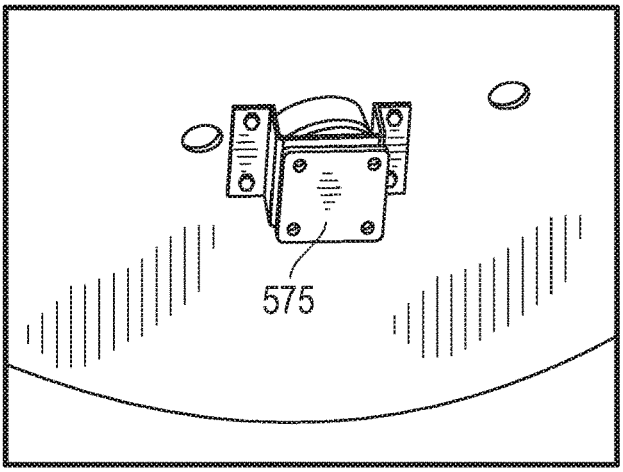
FIG. 8 depicts a perspective view of one embodiment of a ground wire reel and a larger payoff reel system.
Figure 9:
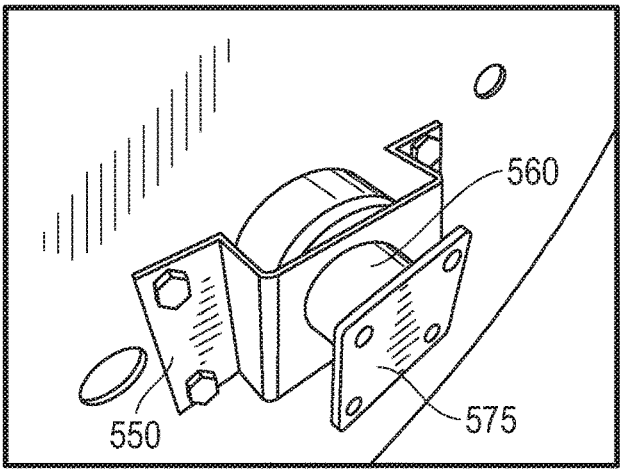
FIG. 9 depicts a perspective view of one embodiment of a ground wire reel and a larger payoff reel system.
Figure 10:
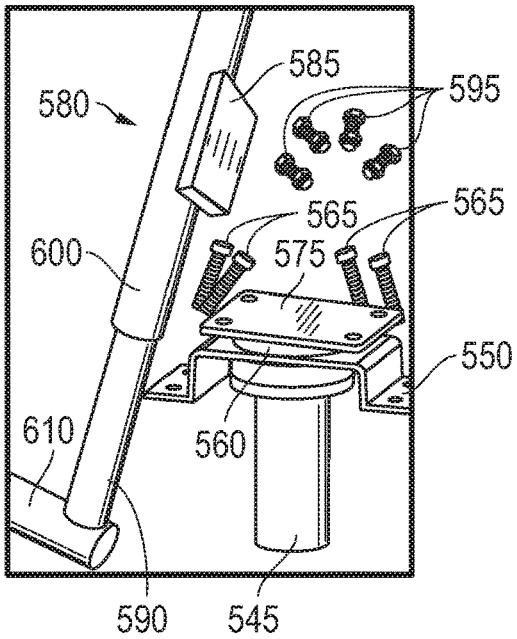
FIG. 10 depicts a perspective view of one embodiment of a ground wire reel and a larger payoff reel adjustable reel lift system (disassembled).
Figure 11:
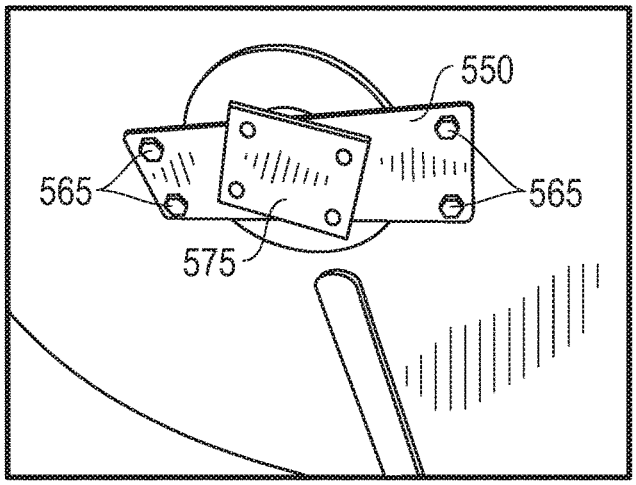
FIG. 11 depicts a perspective view of one embodiment of a ground wire reel and a larger payoff reel system.
Figure 12:
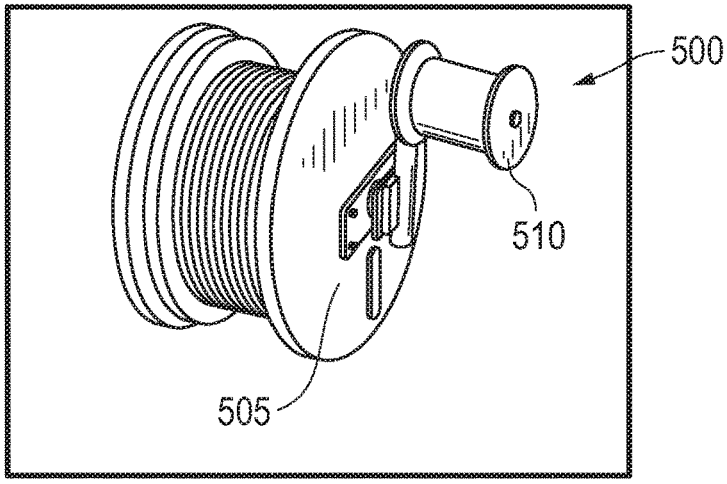
FIG. 12 depicts a perspective view of one embodiment of a ground wire reel and a larger payoff reel system.
Figure 13:
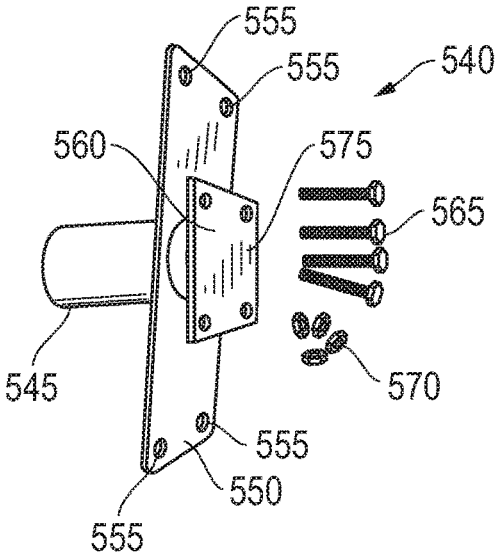
FIG. 13 depicts a perspective view of one embodiment of a ground wire reel and a larger payoff reel adjustable reel lift system (disassembled).
Figure 14:
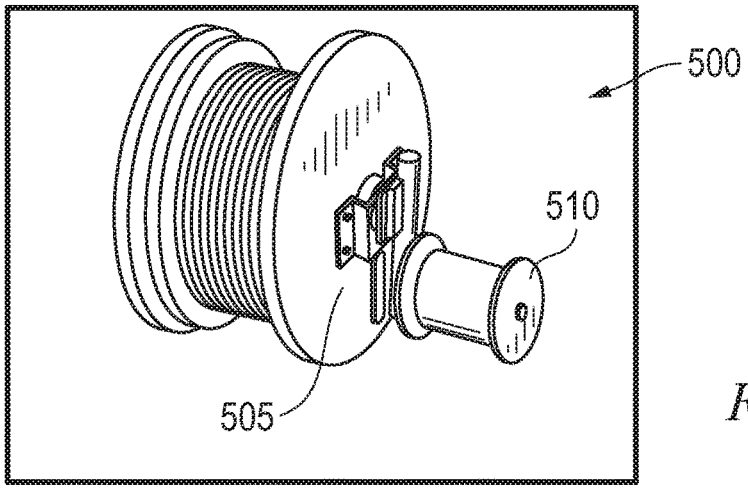
FIG. 14 depicts a perspective view of one embodiment of a ground wire reel and a larger payoff reel system.
Figure 15:
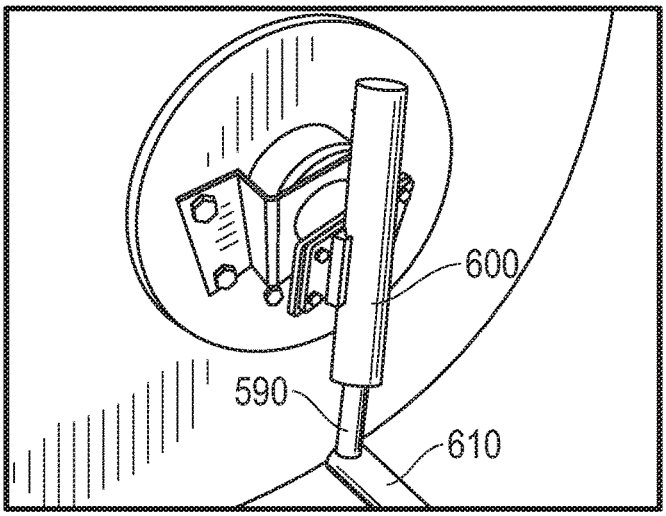
FIG. 15 depicts a perspective view of one embodiment of a ground wire reel and a larger payoff reel system.
Figure 16:
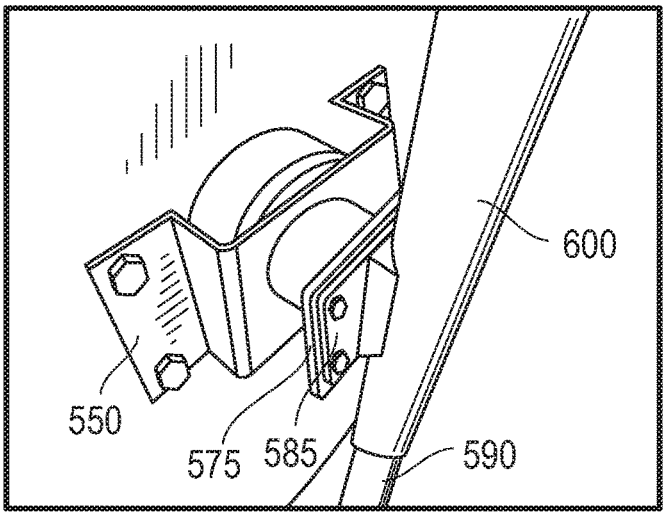
FIG. 16 depicts a perspective view of one embodiment of a ground wire reel and a larger payoff reel system.
Figure 17:
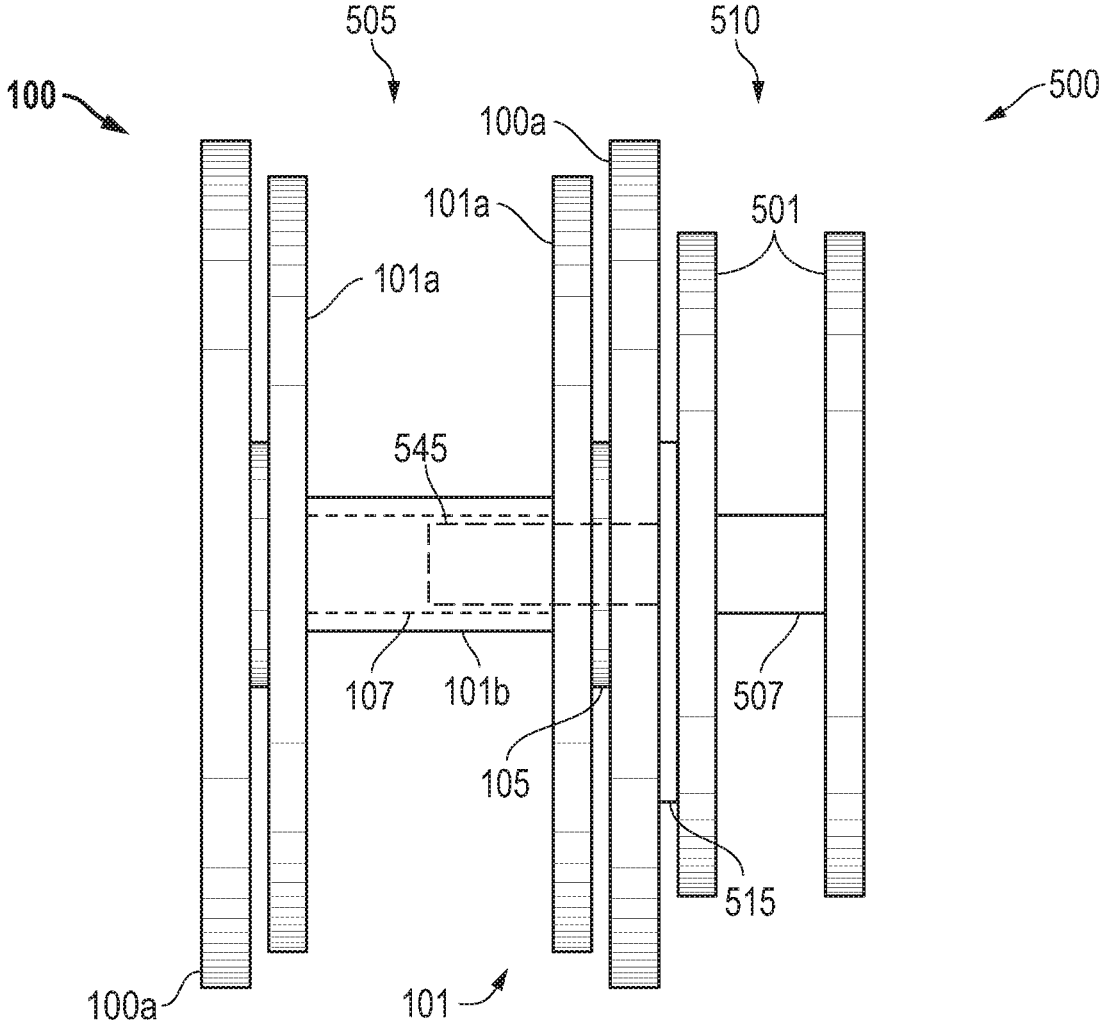
FIG. 17 depicts a front side view of one embodiment of a ground wire reel and a larger payoff reel system.

Referring now to FIGS. 5-17, an exemplary embodiment of a system of a ground wire reel and a larger payoff reel is shown. A side car reel assembly 500 includes a payoff reel 505 and a side car reel 510. The payoff reel 505 includes the same elements and functions the same as the payoff reel 205. The payoff reel 505 includes an outer assembly 100 and an inner assembly 101. The outer assembly 100 is formed by two outer supporting walls 100*a* connected via a tube or drum 107. The tube or drum 107 is hollow forming an arbor holes on each end of the payoff reel 505. Inner assembly 101 is formed by a plurality of inner supporting walls 101*a*, which form at least one bay in the inner assembly 101. The inner assembly 101 may include multiple bays. Each of the inner supporting walls 101*a* is connected to an inner drum 101*b* and all inner support walls 101 move in a way that is independent from the outer assembly 100. The inner drum 101*b* has a diameter greater than the diameter of the tube or drum 107 and the inner drum 101*b* is located around the tube or drum 107.

The side car reel 510 is detachable from the payoff reel 505. The side car reel 510 is formed by two outer supporting walls 501 connected via a tube or drum 507. The tube or drum 507 is hollow forming an arbor holes on each end of the side car reel 510.

The side car reel assembly 500 further includes an adjustable reel lift apparatus 515. The adjustable reel lift apparatus 515 is attached to an outer supporting wall 100*a* of the payoff reel 505 with bolts or other attachment means known to those skilled in the art. The adjustable reel lift 515 is a jack that allows the side car reel 510 to be raised and lowered. The adjustable reel lift 515 includes a fully rotatable arm 520 that allows the side car reel 510 to spin independently from the payoff reel 505 allowing the side car reel 510 to be self-leveling and to be stationary, non-spinning, during movement or adjustment of the payoff reel 505.

The adjustable reel lift 515 includes a base assembly 540 and a jack assembly 580. The base assembly 540 includes a shaft 545 with a diameter smaller than the arbor hole of the payoff reel 505. The shaft 545, in one embodiment, has a length sufficient to extend half way through the payoff reel 505, however, a wide variety of shaft lengths may be implemented without detracting from the spirit of the invention, including without limitation, a length extending all of the way through the payoff reel 505 and a length extending six (6) inches into the payoff reel 505. The shaft 545 is attached to the base plate 550 via attachment mechanisms known to those skilled in the art, including but not limited to, welding. The base plate 550 includes four bolt holes 555 for attachment to the payoff reel 505. In one embodiment, the base plate 550 is also attached to a spinning plate 575 through a bearing 560. In another embodiment, the base plate 550 is fixedly attached to the spinning plate 575 and the spinning plate 575 is rotatably attached to a jack assembly 580. The spinning plate 575 spins in relation to either the base plate 550 or the jack assembly 580. Bolts 565 are placed through the bolt holes 550 and through the payoff reel 505 and nuts 570 are attached to the bolts 565 to secure the base assembly 540 to the payoff reel 505. When secured to the payoff reel 505, the shaft 545 of the base assembly 540 is located in the arbor hole of the payoff reel 505. The base plate 550 may be flush against the payoff reel 505 when secured to the payoff reel 505 or it may be offset around the arbor hole.

The jack assembly 580 of the adjustable reel lift 515 includes a jack plate 585, a jack rod 590, a jack rod housing 600, and a rotatable arm 610. The jack plate 585 is attached to the base plate 550 through the spinning plate 575 and bearing 560. The spinning plate 575 spins, in one embodiment, in relation to the base plate 550. In another embodiment, the spinning plate 575 spins in relation to the jack plate 585. The jack plate 585 is fixedly attached to the jack rod housing 600. The jack rod 590 is located within the jack rod housing 600 and the jack rod 590 is expandable or moveable beyond the jack rod housing 600 through mechanical, pneumatic, or hydraulic mechanisms known to those skilled in the art. In one embodiment, a jack adjustment mechanism 630 in rotated manually or through the use of a power drill to raise or lower the jack rod 590. The jack rod 590 is also rotatably attached to a rotatable arm 610. The rotatable arm 610 diameter is smaller than the diameter of the arbor hole of the side car reel 510. The side car reel 510 is placed over the rotatable arm 610 and secured with a pin or other connection device known to those skilled in the art. The rotatable arm 610 rotates when the wire or cable from the side car reel 510 is pulled from the reel. In another embodiment, the rotatable arm 610 is fixedly attached to the jack rod 590 and the side car reel 510 rotates on the rotatable arm 610. Wire or cable is spooled around the payoff reel 505 and the side car reel 510. The wire or cable may be of the same size and length or the wire or cable may be different lengths or different sizes. During transportation, the payoff reel 505 and side car reel 510 may be attached or may be unattached, allowing for attachment at the job site.

Although the invention is described herein with reference to specific embodiments, various modifications and changes can be made without departing from the scope of the invention as set forth in the claims below. Accordingly, the specification and figures are to be regarded in an illustrative rather than a restrictive sense, and all such modifications are intended to be included within the scope of the invention. Any benefits, advantages, or solutions to problems that are described herein with regard to specific embodiments are not intended to be construed as a critical, required, or essential feature or element of any or all the claims.

From time-to-time, the invention is described herein in terms of these example embodiments. Description in terms of these embodiments is provided to allow the various features and embodiments of the invention to be portrayed in the context of an exemplary application. After reading this description, it will become apparent to one of ordinary skill in the art how the invention can be implemented in different and alternative environments. Unless defined otherwise, all technical and scientific terms used herein have the same meaning as is commonly understood by one of ordinary skill in the art to which this invention belongs.

The preceding discussion is presented to enable a person skilled in the art to make and use the invention. The general principles described herein may be applied to embodiments and applications other than those detailed below without departing from the spirit and scope of the invention as defined by the appended claims. The invention is not intended to be limited to the embodiments shown, but is to be accorded the widest scope consistent with the principles and features disclosed herein.

In addition, while a particular feature of the invention may have been disclosed with respect to only one of several embodiments, such feature may be combined with one or more other features of the other embodiments as may be desired. It is therefore, contemplated that the claims will cover any such modifications or embodiments that fall within the true scope of the invention.

The various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one", "one or more" or the like; and adjectives such as "conventional", "traditional", "normal", "standard", "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more", "at least", "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed across multiple locations.

Unless stated otherwise, terms such as "first" and "second" are used to arbitrarily distinguish between the elements such terms describe. Thus, these terms are not necessarily intended to indicate temporal or other prioritization of such elements.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

All publications and patents mentioned in the above specification are herein incorporated by reference. Various modifications and variations of the described method and system of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are obvious to those skilled in the field or any related fields are intended to be within the scope of the following claims.

What is claimed is:

1. An apparatus for the transportation and dispensing of spooled wire or cable, the apparatus comprising:

a payoff reel, wherein the payoff reel comprises an arbor hole having a payoff reel diameter; and a detachable side car reel, wherein the detachable side car reel comprises an arbor hole having a detachable side car reel diameter and wherein the detachable side car reel is attachable to the payoff reel and wherein the detachable side car reel further comprises a reel lift.

2. The apparatus of claim 1, wherein the reel lift attaches to the payoff reel.

3. The apparatus of claim 2, wherein the reel lift is bolted to the payoff reel.

4. The apparatus of claim 1, wherein the reel lift further comprises a jack.

5. The apparatus of claim 4, wherein the jack raises the detachable side car reel.

6. The apparatus of claim 4, wherein the jack lowers the detachable side car reel.

7. The apparatus of claim 4 further comprising a base attached to the jack.

8. The apparatus of claim 7, wherein the base further comprises a shaft having a diameter smaller than the payoff reel diameter of the payoff reel arbor hole and wherein the shaft is placed within the payoff reel arbor hole.

9. The apparatus of claim 7, wherein the base is attached to the jack with a spinning plate, wherein the spinning plate spins in relation to the base.

10. The apparatus of claim 9, wherein the spinning plate further comprises a bearing.

11. The apparatus of claim 9, wherein the jack further comprises a jack plate, a jack rod, and a rotatable arm.

12. The apparatus of claim 11, wherein the rotatable arm allows the detachable side car reel to spin independently from the payoff reel.

13. The apparatus of claim 12, wherein the rotatable arm is self-leveling.

14. The apparatus of claim 11, wherein the jack plate is attached to the spinning plate.

15. The apparatus of claim 14, wherein the jack plate is fixedly attached to the spinning plate.

16. The apparatus of claim 9, wherein the jack rod is rotatably attached to the rotatable arm.

17. The apparatus of claim 16, wherein the rotatable arm has a rotatable arm diameter smaller than the detachable side car reel diameter of the detachable side car reel arbor hole and wherein the rotatable arm is placed within the detachable side car reel arbor hole.

18. The apparatus of claim 9, wherein the jack rod raises or lowers the rotatable arm.

19. A system apparatus for the transportation and dispensing of spooled wire or cable, the system comprising:

a payoff reel, wherein the payoff reel comprises an arbor hole having a payoff reel diameter;

a first wire or cable spooled around the payoff reel, wherein the first wire or cable has a first size;

a detachable side car reel, wherein the detachable side car reel comprises an arbor hole having a detachable side car reel diameter and wherein the detachable side car reel is attachable to the payoff reel and wherein the detachable side car reel further comprises a reel lift; and a second wire or cable spooled around the detachable side car reel, wherein the second wire or cable has a second size.

20. The system of claim 19, wherein the first size of the first wire or cable is greater than the second size of the second wire or cable.

21. The system of claim 19, wherein the reel lift comprises a jack and wherein the jack raises or lowers the detachable side care reel.

* * * * *